US006055755A

United States Patent [19]

Prokes

[11] Patent Number: 6,055,755

[45] Date of Patent: May 2, 2000

[54] PANEL SUPPORTED SIGN FRAME

[76] Inventor: William J. Prokes, 826 E. Dava Dr., Tempe, Ariz. 85283

[21] Appl. No.: 08/833,211

[22] Filed: Apr. 14, 1997

[51] Int. Cl.[7] ..... G09F 7/22

[52] U.S. Cl. ..... 40/617; 40/606; 40/611; 248/303

[58] Field of Search ..... 40/606, 611, 617, 40/651, 661, 666, 591; 248/215, 303; D20/42

[56] References Cited

U.S. PATENT DOCUMENTS

| | | | |
|---|---|---|---|
| D. 234,443 | 3/1975 | Golub | D20/42 |
| D. 260,782 | 9/1981 | DeMars | D20/42 |
| 534,799 | 2/1895 | Koehler | 40/666 |
| 1,557,955 | 10/1925 | Young | 40/591 |
| 2,524,427 | 10/1950 | Cutaia | 40/651 |
| 2,620,579 | 12/1952 | Dienes | 40/591 |
| 4,171,584 | 10/1979 | Kaiser | 40/661 X |
| 4,798,013 | 1/1989 | Sainato | 40/651 |
| 5,197,215 | 3/1993 | Torsleff | 40/649 X |
| 5,499,789 | 3/1996 | Rose | 40/617 X |
| 5,618,141 | 4/1997 | Field | 40/606 |

FOREIGN PATENT DOCUMENTS

| | | | |
|---|---|---|---|
| 1141424 | 9/1957 | France | 40/591 |

*Primary Examiner*—Brian K. Green
*Attorney, Agent, or Firm*—Cahill, Sutton & Thomas, P. L. C.

[57] ABSTRACT

A dependingly supported self-righting frame for displaying a replaceable sign and having an upwardly extending hook traversing the top edge of a room dividing panel and a stabilizer extending in opposed directions from the hook along the top edge of the panel. The frame includes a base attached to a depending leg of the hook and a pair of parallel opposed channels extending from the base to slidably retain the sign within the channels. The hook prevents movement of the sign away from the underlying panel surface and the stabilizer prevents pivotal movement of the sign in the plane of the panel surface.

12 Claims, 2 Drawing Sheets

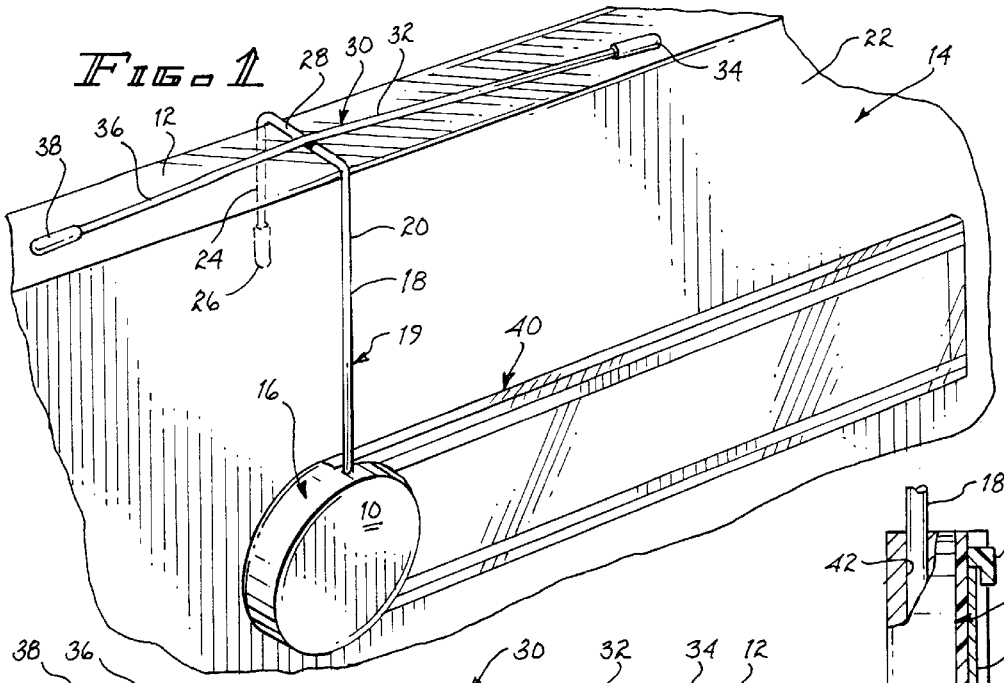
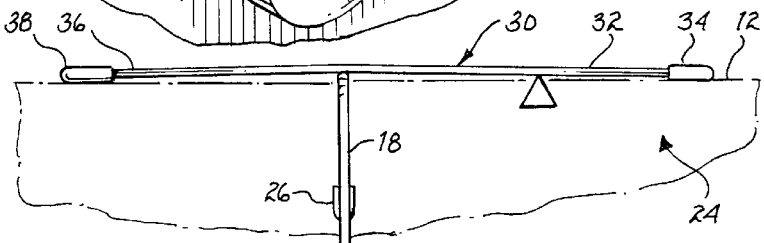
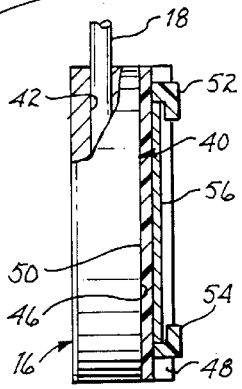
FIG. 3
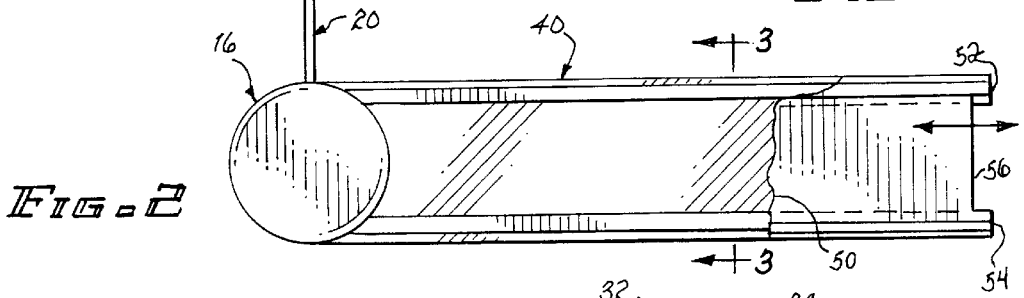
FIG. 2
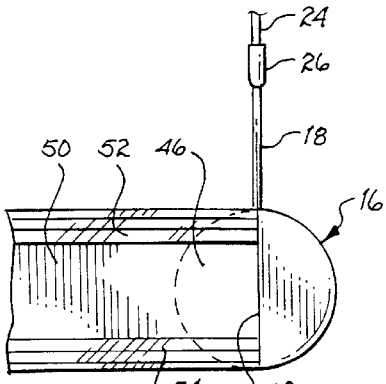
FIG. 4
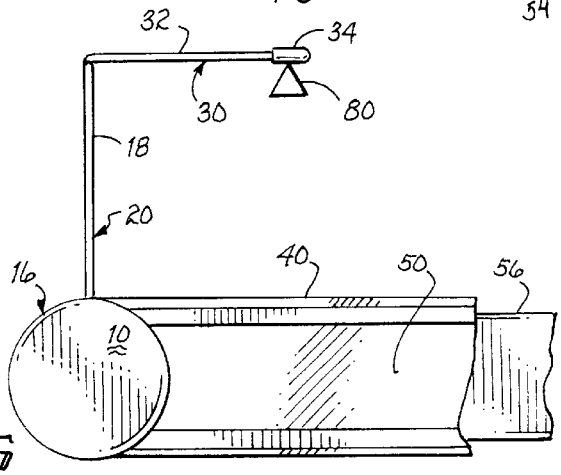
FIG. 5

PANEL SUPPORTED SIGN FRAME

BACKGROUND OF THE INVENTION

1. Field of the Invention

The present invention relates to signs and, more particularly, to panel supported removable frames for retaining interchangeable signs.

2. Description of Related Art

A plurality of moveable room dividers or panels are often used in large offices to define work areas or cubicles for individuals or small groups of individuals. Each of these panels is generally self-supporting and readily moveable. Each panel may be on the order of three feet wide and five to six feet in height, depending upon the degree of privacy sought. The surfaces of a panel are often of a cloth or clothlike material to serve a dual function of decoration and sound absorption. For identification purposes, it is important to place one or more signs on the panels to designate the nature of the delineated work area or the name or names of the persons working within the delineated office.

If such signs are attached to the exterior material of a panel, the material is usually defaced, marred, or otherwise damaged. Since the panels are often used for temporary delineations, permanently attached signs are usually not practical. Because the panels are moveable, any movement of the panel, whether intentional or unintentional, will almost always result in an attached sign becoming skewed or otherwise repositioned, even to the extent of falling off the panel. The permanency of the attachment mechanism for the sign is a function of the required immobility of the sign during anticipated movement of the panel and also a function of the acceptable degree of damage to the panel upon removal or replacement of the sign. It follows that the greater the required immobility, the greater the likelihood of defacing the panel upon deliberate removal of the sign. Compromises must therefore be made and the presently known and useable types of signs are insufficiently satisfactory.

Because of the temporary nature of such panels, it is not unexpected or unusual for the panel to be jostled or otherwise physically disturbed. Any such disturbance will cause misalignment or skewing of any sign attached thereto unless the attachment is rigid to prevent such relative movement between the panel and the sign. Any misalignment or skewing must thereafter be manually corrected.

SUMMARY OF THE INVENTION

The present invention is directed to a sign supporting frame removably suspended from the top edge of a space delineating panel. The frame includes a bracket having a hook extending upwardly from a base, across the front surface of the panel, across the top edge of the panel, and partly down the rear surface of the panel. This hook dependingly supports the frame. A stabilizer extends in opposed directions from the hook along the top edge of the panel to prevent rocking movement of the frame in response to inadvertent or deliberate movement of the panel. Moreover, the stabilizer will reorient the frame to its former predetermined orientation relative to the panel after a disturbance of the orientation of the frame. The frame includes a pair of parallel opposed channels extending from the base for slidably and removably receiving a plate or sign having indicia thereon. Attachment of the frame to a panel is by a simple act of hooking the hook over the top edge of the panel which positioning places the base adjacent the front surface of the panel and inherently locates the stabilizer adjacent and along the top edge of the panel. The frame is readily removable from the panel by simply lifting it up, which removal causes no damage or marring of the surfaces of the panel. Accordingly, mounting and dismounting of the frame is easily performed without the use of any tools or attachment elements penetrably or adhesively engaging the panel. Moreover, the sign is easily slidably replaced with or without dismounting of the frame.

It is therefore a primary object of the present invention to provide a readily detachably attachable sign supporting frame for use with room dividing panels.

Another object of the present invention is to provide a dependingly supported self-righting sign frame for use with a panel.

Still another object of the present invention is to provide a dependingly supported frame for retaining replaceable signs.

Yet another object of the present invention is to provide a panel mounted self-righting sign supporting frame that reorients itself to its previously predetermined orientation relative to the panel upon disturbance from the predetermined orientation.

A further object of the present invention is to provide a sign frame mountable upon a moveable panel without penetrating or adhering to the panel.

A still further object of the present invention is to provide a dependingly supported sign frame acting as a pendulum to right itself in the event of temporary misalignment.

A still further object of the present invention is to provide a panel detachably attachable sign supporting frame having a functional part configured as a logo or any other selected shape.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which:

FIG. 1 illustrates a perspective view of the present invention mounted upon a panel;

FIG. 2 is a front elevational view of the sign supporting frame;

FIG. 3 is a cross-sectional view taken along lines 3—3, as shown in FIG. 2;

FIG. 4 is a partial rear view of the sign supporting frame;

FIG. 5 illustrates a variant of the bracket for the sign supporting frame;

DETAILED DESCRIPTION OF THE PREFERRED EMBODIMENT

Figure 6:
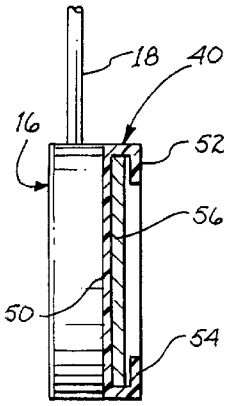
FIG. 6 is an end view of the sign retaining element.
Figure 7:
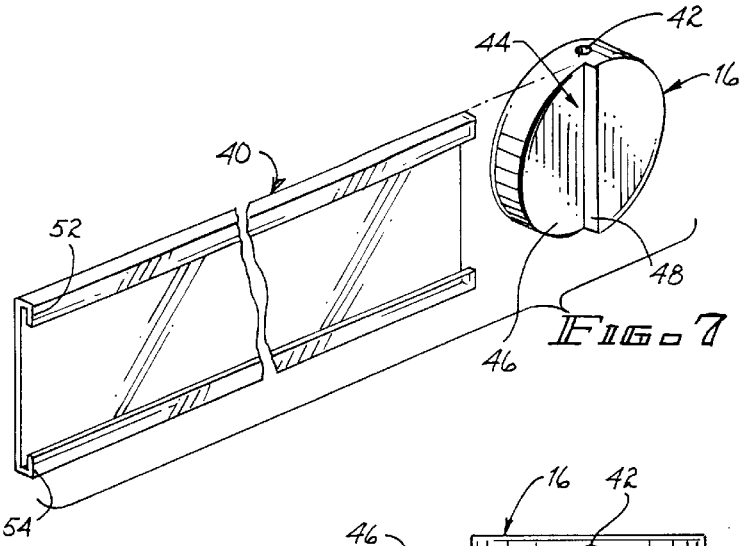
FIG. 7 is an exploded view of the sign retaining element and the base.
Figure 8:
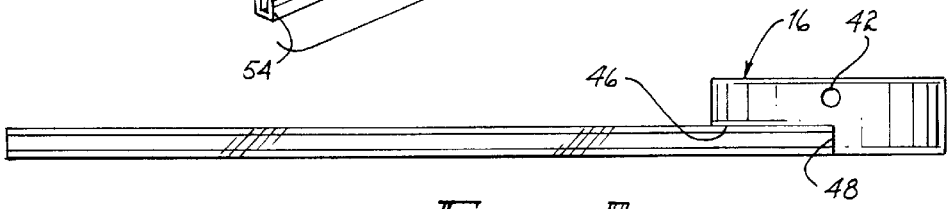
FIG. 8 is a top view of the sign retaining element and the base.

Many office complexes, product assembly areas, and service areas within places of business use moveable self-supporting wall panels for the purpose of delineating specific offices or work areas. These panels provide the requisite degree of privacy and insulation against adjacent disturbing influences yet they do not incur the expenses and constraints of permanent walls. Furthermore, the size of the offices and work areas can be enlarged or reduced commensurate with changes in workloads without any difficulty by simply relocating the space delineating panels. The panels are often faced with decorative surfaces for their inherent aesthetic value in order to help create the kind of atmosphere sought.

It is usually important to designate the delineated space with the name or names of individuals working there, the function of the work area, or the equipment located within the work area. The most logical location for placing signs conveying such designations is upon one of the panels delineating the respective area. Since temporary panels usually delineate temporary requirements for work areas or offices, changes of the indicia appearing upon signs attached to the panels must be expected. When such signs are changed or removed, the panels are often defaced due to the manner of attachment. Such defacement is aesthetically displeasing and incurs expenses to correct. A need therefore exists to provide a removable panel mounted sign frame that maintains its orientation despite disturbances.

Sign supporting frame 10 illustrated in FIG. 1 is dependingly supported from top edge 12 of a panel 14; it is to be understood that the panel is representative of many types of support structures, such as a door, wall, cabinet door, etc. The frame includes a base 16 depending from leg 18 of a panel engaging bracket 19, such as hook 20. The hook may be of wire, as depicted, that extends upwardly from the base and essentially along front surface 22 of panel 14, across top edge 12 and terminating in leg 24 extending downwardly along the rear surface of the panel. Leg 24 may be terminated by a plastic cap 26 or the like to prevent defacing of the panel surface. The combination of legs 18 and 24 being positioned adjacent opposed surfaces of panel 14 essentially precludes displacement of base 16 laterally away from front surface 24 more than limited amount.

A stabilizer 30 extends in opposed directions from center leg 28 of hook 20. Leg 32 of the stabilizer is terminated with a cap 34 lodged against top edge 12 and leg 36 of the stabilizer is terminated by a cap 38 also lodged against the top edge. Pivotal movement of hook 20 about the axis represented by center leg 28 is precluded in either direction by contact of caps 34,38 (or legs 32,36) with top edge 12. Moreover, by bending legs 32,36 downwardly sufficiently to raise center leg 28 from the top surface, the stabilizer serves as a load bearing element supporting frame 10. Stabilizer 30 of bracket 19 serves as a stabilizing element to return frame 10 to a predetermined orientation with respect to panel 14 after an intermittent disorientation of the frame, such as might be caused by the panel being jostled or deliberately moved. If movement of the panel causes frame 10 to be pivotally repositioned, a corresponding one of legs 32,36 would no longer be in contact with top edge 12 of panel 14. The center of gravity of the frame acts through the stabilizer at a location between the terminal end of the leg remaining in contact with the top edge and the terminal end of the raised leg. The resulting imbalance of forces urges downward rotational movement of the frame about the contact point between the stabilizer and the top edge until such movement is terminated by contact of both terminal ends of the stabilizer with the top edge. When such contact is achieved, the frame again rests at its predetermined orientation with respect to the panel. Thus, frame 10 is self-stabilizing and will return to a predetermined orientation after a disturbance.

While bracket 19 has been shown and described as being a hook 20 formed of wire, it is to be understood that the bracket can be of other materials and configurations, i.e. it could be molded or otherwise formed of plastic material.

Referring jointly to FIGS. 1, 2, 3, 4, 6, 7, and 8, base 16 and sign supporting element 40 will be described. Base 16 includes a cavity 42 for receiving and retaining the lower end of leg 18 of hook 20. A recess 44 is formed in base 16 by wall 46 and shoulder 48. The recess is configured to receive one end of element 40 and to secure the element to base 16 in a fixed relationship. Element 40 may be formed as a single unit, as illustrated. It includes a transparent panel 50 bounded on opposed edges by opposing channels 52,54. The channels serve as guideways for slidingly receiving a plate 56 having indicia disposed thereon for viewing through transparent panel 50. In this manner, plate 56 serves as the sign which is supported and retained in place by frame 10. By inspection, it is readily apparent that the indicia to be displayed is readily changeable by replacing plate 56 with another plate bearing the appropriate indicia.

Figure 9A:
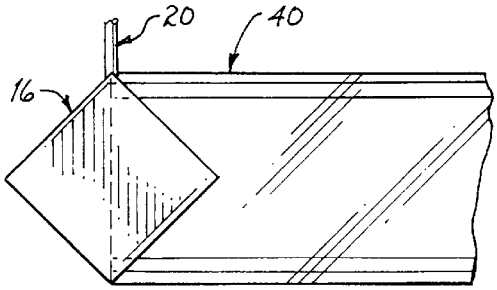
FIGS. 9A, 9B, 9C, and 9D illustrate variant configurations of the base for aesthetic purposes.
Figure 9B:
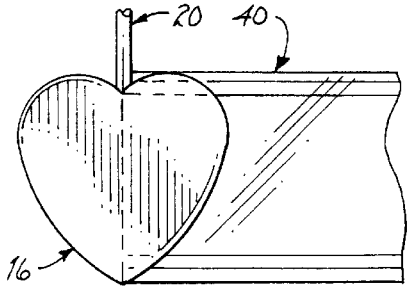
Figure 9C:
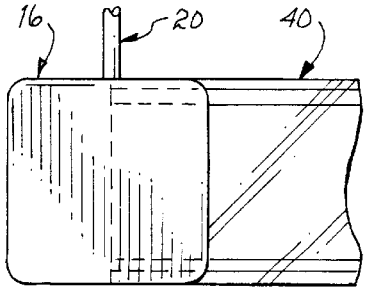
Figure 9D:
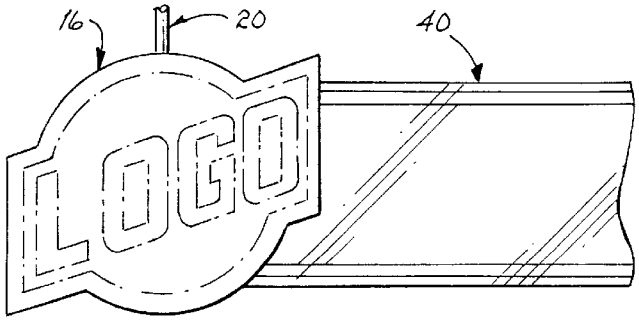

As shown in FIGS. 9A, 9B, 9C, and 9D, roundel shaped base 16 can, in fact, be of any shape. For instance, it may be diamond shaped as shown in FIG. 9A. It may be shaped to evoke a particular emotional reaction, such as the heart shape shown in FIG. 9B. Moreover, base 16 may be of a traditional square shape as shown in FIG. 9C. To imbue a viewer with a sense of company allegiance or otherwise promote the culture of a company, base 16 may depict the company logo, as representatively illustrated in FIG. 9D.

Figure 10:
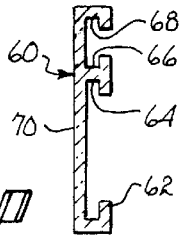
FIG. 10 illustrates a variant of the sign retaining element.

In specific office or manufacturing environments, it may be beneficial to have adjacent segregated signs to permit replacement of only one of the signs during a change of personnel or work function. A variant 60 of element 40 is depicted in cross-section in FIG. 10. The variant includes two pairs of opposed channels 62,64 and 66,68 extending from a panel 70. A plate bearing a first set of indicia, such as a name, may be slidably inserted within channels 62 and 64. A further plate bearing indicia, such as a title or position, may be slidably inserted within channels 66,68. Thus, variant 60 permits ready replacement of either plate bearing its respective indicia. Panel 70 may be transparent to permit viewing of the sign therethrough or it may be either transparent or opaque if the indicia on the sign is to be exposed for direct viewing with the panel being disposed at the rear of the sign.

As shown in FIG. 3, channels 52,54 of element 40, as well as pairs of channels 62,64 and 66,68 of element 60, may be formed as separate elements and secured to their respective panels. Moreover, the orientation of the panels and the corresponding channels may be reversed in position such that plate 56, the sign, is in front and the panel is behind it.

Referring to FIG. 5, both a variant of frame 10 and a certain aspect of the dynamic operation of frame 10 will be described. As described with respect to FIG. 1, the weight of frame 10 may be primarily supported by center leg 28 of hook 20 extending across the top of panel 14. The purpose of stabilizer 30 may be primarily that of precluding pivotal movement of frame 10 about an axis represented by leg 28. However, stabilizer 30 can be configured to be a load bearing member to help support frame 10 or provide all of the support for the frame by orienting legs 32,36 downwardly sufficiently to have caps 34,38 (or leg ends) exert a load bearing force upon top edge 12.

As represented in FIG. 5, the weight of frame 10 can be supported from a specific point by cap 34 (or the terminal end of leg 32) if the cap (or terminal end) is on a vertical line extending through the center of gravity of frame 10, which point is represented by balance point 80. When so supported, frame 10 will be suspended with element 40 being horizontally located, as depicted. With this configuration, frame 10 would be suspended in the manner of a pendulum and it would always return to its original position (or predetermined orientation) after having been disturbed due to movement of the supporting panel or other disturbing factor. As the combined length of base 16 and element 40 extends laterally along front surface 22 of panel 14 for a significant distance on either side of balance point 80, contact of the base and the element with the surface of the panel would prevent rotation of frame 10 about a vertical axis extending through balance point 80. For the configuration shown in FIG. 5, only leg 18 and leg 32 of bracket 19 are required provided that leg 32 is oriented away from a plane extending vertically through base 16 and element 40 sufficiently to permit the end of leg 32 to rest upon top edge 12 of panel 14.

While the invention has been described with reference to several particular embodiments thereof, those skilled in the art will be able to make the various modifications to the described embodiments of the invention without departing from the true spirit and scope of the invention. It is intended that all combinations of elements and steps which perform substantially the same function in substantially the same way to achieve the same result are within the scope of the invention.

What is claimed is:

1. A frame for dependingly supporting a sign from a top edge of a support structure having a front side and a back side, said frame comprising in combination:

(a) a bracket adapted to engage the support structure to receive support therefrom, said bracket including 1) a hook comprising a center leg adapted to extend transversely across the top edge of the support structure from the front side to the back side of the support structure, a front leg depending from one end of said center leg and a back leg depending from another end of said center leg, and 2) a stabilizer comprising a pair of legs extending in opposed directions, each leg of said pair of legs being attached directly to and extending from said center leg and including an end adapted to engage the top edge of the support structure;

(b) a base, said base being supported from said front leg of said hook; and (c) an element extending from said base and adapted to support a sign to be displayed adjacent the front side of the support structure.

2. The frame as set forth in claim 1 wherein said element includes opposed channels for slidably receiving and retaining the sign.

3. The frame as set forth in claim 2 wherein said element includes a transparent panel supporting said channels.

4. The frame as set forth in claim 1 wherein said bracket is of wire.

5. The frame as set forth in claim 4 wherein said front leg of said hook penetrably engages said base.

6. The frame as set forth in claim 1 wherein said stabilizer is of wire.

7. A self-righting frame for supporting a sign at a predetermined orientation adjacent a front surface of a support structure having a top edge and a back surface and for reorienting the sign to the predetermined orientation after an intermittent induced movement of said frame induced by an external force, said frame comprising:

(a) a bracket for engaging the support structure said bracket including a center element adapted to extend across the top edge of the support structure, a front element depending from one end of said center element and a back element depending from another end of said center element and thereby said bracket is supported by the support structure and adapted to have said front element extend along the front surface of the support structure;

(b) a sign supporting element interconnected with said front element of said bracket and adapted to extend along the front surface of the support structure for supporting the sign adjacent the front surface of the support structure; and (c) a stabilizer secured to said center element of said bracket for stabilizing said frame, said stabilizer comprising a pair of legs extending in opposed directions from said bracket, each leg of said pair of legs including one end attached directly to said center element and a terminal end adapted to rest upon the top edge of the support structure for maintaining the sign in the predetermined orientation and for returning the sign to the predetermined orientation in response to the force of gravity acting upon said sign supporting element and the supported sign and after an intermittent movement of said frame induced by an outside force.

8. The frame as set forth in claim 7 wherein said stabilizer is of wire.

9. The frame as set forth in claim 7 wherein the center of gravity of said frame is disposed in a vertical line between said terminal ends of said pair of legs to define the predetermined orientation of said frame and to urge each terminal end of said pair of legs to return to contact the top edge of the support structure after an intermittent induced movement of said frame.

10. The frame as set forth in claim 7 wherein said bracket is of wire.

11. A sign frame dependingly supportable from a panel having a top edge for retaining a sign, said frame comprising in combination:

(a) a bracket adapted for engaging the top edge of the panel and extending adjacent front and back surfaces of the panel adjacent the top edge of the panel, said bracket including a center element adapted to extend across the top edge of the panel, a front element depending from one end of said center element, and a back element depending from another end of said center element;

(b) a sign supporting element for interconnecting the sign with said front element and extending from said bracket in one direction for retaining the sign to be displayed adjacent the front side of the panel; and (c) a stabilizer having one end of at least one leg attached directly to said center element, said at least one leg extending from said center element of said bracket in the same direction in which said sign supporting element extends from said front element of said bracket, said leg of said stabilizer having a terminal end adapted to rest upon the top edge of the panel.

12. The sign frame as set forth in claim 11 wherein said sign supporting element is configured as a logo.

* * * * *